United States Patent [19]

Spiering

[11] Patent Number: 4,682,691

[45] Date of Patent: Jul. 28, 1987

[54] ROLL-UP VELCRO TOOL CARRIER

[76] Inventor: Johan R. Spiering, 105 Queen Anne Road, Toronto, Ontario M8X 1T3, Canada

[21] Appl. No.: 848,804

[22] Filed: Apr. 7, 1986

[51] Int. Cl.[4] ..... B65D 85/20

[52] U.S. Cl. ..... 206/373; 150/52 R; 206/460; 206/813; 248/205.2

[58] Field of Search ..... 150/52 B, 52 C, 52 R; 206/214, 349, 372, 373, 460, 813; 248/205.1, 205.2, 205.3, 205.4

[56] References Cited

U.S. PATENT DOCUMENTS

| | | | |
|---|---|---|---|
| 3,321,068 | 5/1967 | Beach | 248/205.2 |
| 3,327,419 | 6/1967 | Stanos | 248/205.2 |
| 3,370,818 | 2/1968 | Perr | 248/205.2 |
| 3,944,069 | 3/1976 | Eldridge, Jr. | 206/460 |
| 4,241,833 | 12/1980 | Luebcke | 206/373 |
| 4,334,612 | 6/1982 | Beato | 206/373 |
| 4,441,639 | 4/1984 | Craw et al. | 150/52 R |
| 4,555,018 | 11/1985 | Cho | 206/460 |
| 4,620,396 | 11/1986 | Bjorntwedt | 52/3 |

FOREIGN PATENT DOCUMENTS

| | | | |
|---|---|---|---|
| 0101042 | 2/1965 | Denmark | 248/205.2 |

*Primary Examiner*—Stephen Marcus
*Assistant Examiner*—Jimmy G. Foster
*Attorney, Agent, or Firm*—Sim & McBurney

[57] ABSTRACT

A roll-up carrier incorporates a rectangular sheet of flexible material with one or more strips of a first adhesive material secured to one surface parallel to a pair of edges, and one or more strips of a second adhesive material secured to the other surface juxtaposed with respect to the strips of first adhesive material. The first and second adhesive materials are preferably Velcro, and can be engaged with each other by pressure. A handle is provided, and pieces of the second adhesive material are attached to tools, implements, or other items to be carried in the carrier. One or more strips of the first adhesive material are mounted horizontally on a supporting surface so that the carrier can be mounted against the wall to constitute a wall support for the tools or other implements.

8 Claims, 2 Drawing Figures

ROLL-UP VELCRO TOOL CARRIER

This invention relates generally to flexible containers for holding implements such as tools, and has to do particularly with a flexible, roll-up container for this purpose.

BACKGROUND OF THIS INVENTION

It is well known to provide flexible carriers for tools or other implements in the form of a roll-up sheet of flexible material, containing internal pockets in which the tools or other implements can be stored. One prior patent exemplifying this previous construction is U.S. Pat. No. 4,210,244, issued July 1, 1980 to Westrick.

Two other patents of interest in this regard are U.S. Pat. No. 4,334,612, issued June 15, 1982 to Beato, and U.S. Pat. 1,673,602, issued June 12, 1928 to Sternthal.

It is also well known to utilize the material sold commercially under the name Velcro, consisting of cooperating strips or sheets of adhesive material, one of the materials having tiny plastic hooks extending therefrom, the other material having tiny plastic loops extending therefrom. When pressed together, the hooks engage the loops, and retain the two materials together. The hooks and loops can be disengaged from each other upon the application of a sufficient separating force. It is further known to utilize Velcro-type material to secure implements against supporting strips or sheets. Two patents exemplifying this prior art are U.S. Pat. No. 3,387,341, issued June 11, 1968 to Mates et al, and U.S. Pat. No. 3,370,818, issued Feb. 27, 1968 to Perr.

I have perceived a need for a versatile flexible implement carrier of the roll-up variety which is superior to the carriers shown in U.S. Pat. Nos. 4,210,244, 4,334,612 and 1,673,602, and I have discovered a novel and unobvious way to utilize Velcro-type material to accomplish this purpose. The novel construction does not consist simply in applying the Velcro fastening principle shown, for example, in U.S. Pat. No. 3,387,341 to the rectangular carrier shown in U.S. Pat. No. 4,210,244. It might alleged to be obvious to replace the internal pockets of U.S. Pat. No. 4,210,244 with the fastening arrangement shown in U.S. Pat. No. 3,387,341 or in U.S. Pat. No. 3,370,818. However, I have gone further than such a simple substitution, by providing Velcro strips not only on the inside surface of the rectangular carrier, but on the outside surface as well, in precise juxtaposition with the inside strips. The strips on one surface are of the opposite material to the strips on the other surface. By arranging for precise juxtaposition of the strips on either surface of the sheet-like carrier, the carrier itself becomes infinitely adjustable because when it is rolled up upon itself in spiral fashion, the inside strips marry up with the outside strips regardless of how few or how many tools or other implements the carrier contains. I further provide, in a preferred embodiment, a flexible handle on the outside surface of the carrier adjacent one of the ends thereof, to facilitate transportation. The individual tools or other implements have attached thereto smaller pieces of the same Velcro substance as is found on the outside surface of the flexible carrier, thus allowing the tools to be adhered to the Velcro on the inside of the carrier.

GENERAL DESCRIPTION OF THIS INVENTION

More particularly, this invention provides, in combination:

a substantially rectangular sheet of flexible material haing two opposed surfaces, a pair of side edges and a pair of end edges, the longer dimension of the sheet being such as to allow the sheet to be rolled up to surround a plurality of implements, at least one strip of a first adhesive material secured to one surface of said sheet substantially parallel to the pair of side edges, said strip beign narrower than the rectangular sheet, for each strip of said first adhesive material, a strip of a second adhesive material secured to the other surface of said sheet in juxtaposition to its respective strip of first adhesive material, each adhesive material being of a type to be more pressure engageable to the other adhesive material than to itself, the two adhesive materials being disengageable from each other by pulling apart, and a plurality of pieces of said second adhesive material, each said piece being pressure engageable to the strip of first adhesive material on the rectangular sheet and each having means for attachment to implements.

GENERAL DESCRIPTION OF THE DRAWINGS

One embodiment of this invention is illustrated in the accompanying drawings, in which like numerals denote like parts throughout the several views, and in which:

FIG. 1 is a vertical sectional view of the various components of the carrier, showing a tool and a vertical wall surface to which the carrier can be juxtaposed and adhered, all in exploded relation to each other; and FIG. 2 is a perspective view of the carrier of this invention.

DETAILED DESCRIPTION OF THE DRAWINGS

Figure 2:
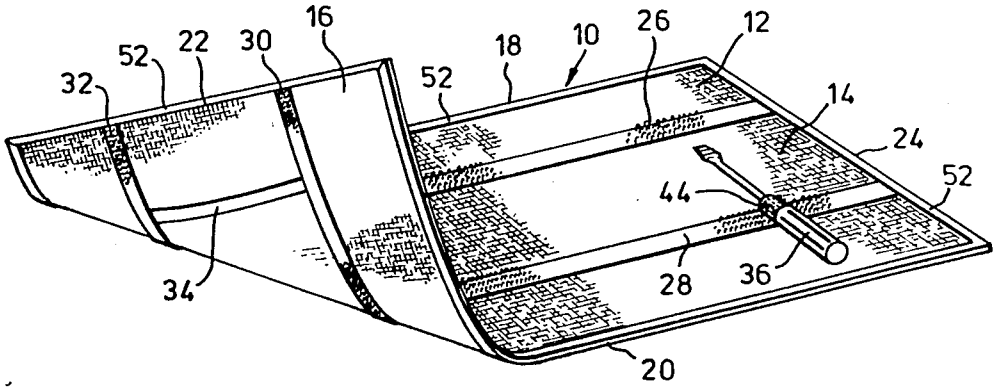

Attention is first directed to FIG. 2, which shows a carrier generally at the numeral 10, the carrier being a substantially rectangular sheet 12 of flexible material such as woven nylon, having two surfaces 14 and 16, a pair of side edges 18 and 20, and a pair of end edges 22 and 24. In the embodiment shown, two strips 26 and 28 of a first adhesive material are secured to the surface 14 of the sheet 12, the strips 26 and 28 being spaced apart and being parallel to each other and to the pair of edges 18 and 20. To give an approximate idea of relative dimensions, each of the strips 26 and 28 is located approximately two-sevenths of the distance from one side edge toward the other side edge. Although the embodiment illustrated shows the use of two strips 26 and 28, it will be understood that fewer or more strips could be utilized if desired, and that the spacing separating the strips perpendicularly is not critical.

For each strip 26 and 28 of the first adhesive material, a strip of a second adhesive material is secured to the other surface 16 of the sheet 12 in juxtaposition to its respective strip of first adhesive material. Looking at FIG. 2, a strip 30 of the second adhesive material is juxtaposed opposite the strip 28, while a strip 32 of second adhesive material is juxtaposed with respect to the strip 26. The first and second adhesive materials are such that they are pressure-engageable with each other, and can be disengaged from each other by pulling the two materials apart. The first and second materials can be the two cooperating materials comprising what is sold commercially under the trade mark Velcro. In the case where Velcro is utilized, it is preferred that the first adhesive material constituting the strips 26 and 28 be the hook portion of Velcro, and that the second adhesive material constituting the strips 30 and 32 be the loop portion of Velcro. The strips 26, 28, 30 and 32 can be secured to the sheet 12 by stitching in known manner.

As seen to the left in FIG. 2, a flexible handle 34 is secured between the strips 30 and 32 adjacent but somewhat spaced from the end edge 22. Preferably, the handle 34 is a flexible band of strong nylon material, and its ends can be stitched in under the strips 30 and 32 in order to ensure a strong attachment.

Figure 1:
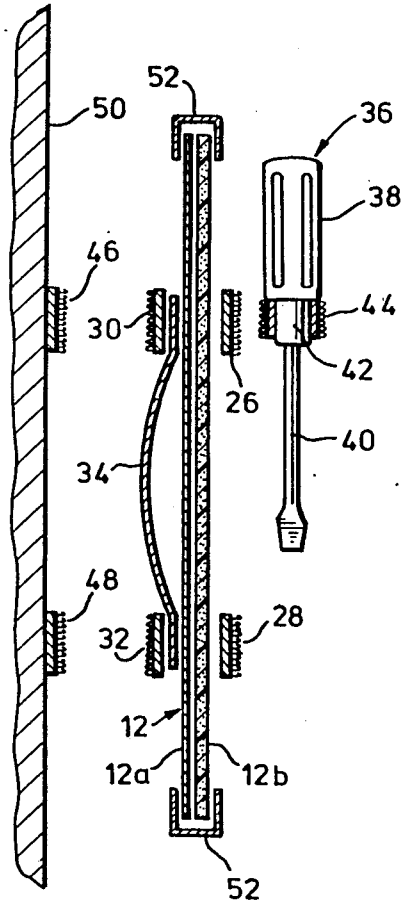

The combination which I provide further includes a plurality of pieces of the second adhesive material for attachment to implements in the manner shown in FIG. 1. In FIG. 1, a screwdriver 36 has a handle 38 and a shaft 40. The handle 38 has a narrower portion 42, and around the narrower portion 42 a piece 44 of the second adhesive material is secured. This can be done by gluing, taping, or pressure-sensitive adhesive, as desired. Since the piece 44 and the strip 26 are of opposite materials, they will engage each other in a gripping fashion, thus securing the screwdriver against the surface 14 of the sheet 12. It will be understood that a large number of such pieces 44 would be provided to the user of my invention, so that he could affix them to various tools or other implements which he wishes to carry in the carrier.

Finally, the preferred form of the invention shown in the embodiment of the Figures incorporates two strips 46 and 48 of the first adhesive material for mounting horizontally on a supporting surface 50 in spaced-apart relation equivalent to the perpendicular spacing between the strips 30 and 32. Since the strips 46, 48 and the strips 30, 32 are of opposed material, they will cooperate together to hold the carrier 10 in position on the wall 50, thus providing a convenient wall storage for the tools or other implements, from which they may be readily obtained and then replaced.

Turning to FIG. 1, the preferred embodiment of this invention utilizes a sheet 12 which is a composite of an actual nylon woven sheet **12*a* and a foam backing material 12*b* which provides the surface 14 shown in FIG. 2. Thus, the strips 26 and 28 of the first adhesive material are secured against the foam backing material 12*b*** in the preferred embodiment.

Also in the preferred embodiment, the edges 18, 20, 22 and 24 are reinforced by an edging reinforcement material 52 stitched into place in known manner.

It will thus be appreciated that I have provided a specially designed implement carrier of the roll-up variety, which is capable of holding a few up to a large number of implements, while attaining a strong closed position in which the strips 26, 28 cooperate with the strips 30, 32 to hold the carrier in its rolled-up position. Regardless of the number of convolutions or "wraps" of the carrier, the contact between the strips 26, 28 and the strips 30, 32 will take place.

A further advantage of the carrier which I have provided lies in the fact that it can be used to cooperate with another like carrier. This is done by laying one of the carriers down in slightly overlapping relation with the other, so that the strips 30 and 32 of the one carrier lie over and in engagement with the strips 26, 28 of the other. In FIG. 2, for example, it can be imagined that another identical carrier could be laid down to overlap the righthand end edge 24, such that the strips 30, 32 of the second carrier extend in gripping juxtaposition with the strips 26, 28 of the first carrier up to the position of approximately the screwdriver 36 shown in FIG. 2. Then, tools or other implements can be placed along both carriers, and the second carrier which overlaps the carrier shown in FIG. 2 would be the first to be rolled, the rolling beginning at the further end and proceeding toward the carrier shown in FIG. 2.

As a non-limiting example, the sheet 12 may measure approximately 16" by 40".

It will thus be appreciated that the strips 30 and 32 on the outside surface 16 of the carrier serve three purposes, in the preferred embodiment. The first purpose is to allow the carrier to be secured against horizontally mounted strips 46 and 48 on a vertical surface, thus holding the carrier in place on a wall. The second purpose is to allow the carrier to be rolled up on itself in a secure manner so that it will not unroll. This occurs because the strips 30 and 32 cooperate with the inside strips 26 and 28. Finally, the strips 30 and 32 allow two substantially identical carriers to be "married together" in the manner previously described, in order to provide an elongated carrier that can likewise be rolled up on itself to carry a larger number of tools or implements.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. In combination:

a substantially rectangular sheet of flexible material having two opposed surfaces, a pair of side edges and a pair of end edges, the longer dimension of the sheet being such as to allow the sheet to be rolled up to surround a plurality of implements, at least one strip of a first adhesive material secured to one surface of said sheet substantially parallel to the pair of side edges, said strip being narrower than the rectangular sheet, for each strip of said first adhesive material, a strip of a second adhesive material secured to the other surface of said sheet in juxtaposition to its respective strip of first adhesive material, each adhesive material being of a type to be more pressure engageable to the other adhesive material than to itself the two adhesive materials being disengageable from each other by pulling apart, and a plurality of pieces of said second adhesive material each said piece being pressure engageable to the strip of first adhesive material on the rectangular sheet and each having means for attachment to implements.

2. The combination claimed in claim 1 further including flexible handle means secured to said other side of the sheet, and also including at least one strip of said first adhesive material for mounting horizontally on a supporting surface.

3. The combination claimed in claim 2, in which there are two strips of said first adhesive material secured to said one surface of the sheet in spaced-apart parallel relation, and two strips of said second adhesive material secured to the other surface of the sheet, there being further two strips of said first adhesive material for mounting horizontally on a supporting surface.

4. The invention claimed in claim 3, in which the flexible handle means comprises a flexible band extending between and secured to the two strips of said second adhesive material adjacent one of the edges to which the strips are at right angles.

5. The invention claimed in claim 4, in which the first and second adhesive material are respectively the cooperating hook and loop materials of Velcro.

6. The invention claimed in claim 5, in which the edges of said sheet have edging reinforcement material secured thereto.

7. The invention claimed in claim 6, in which said sheet is of a nylon woven material.

8. The invention claimed in claim 7, in which the sheet includes a thin layer of foam backing material on said one surface, the strips of said first adhesive material being secured against said foam backing material.

* * * * *